United States Patent [19]

Nagamoto et al.

[11] Patent Number: 4,498,065

[45] Date of Patent: Feb. 5, 1985

[54] ELECTROMAGNETIC RELAY

[75] Inventors: Mitsuki Nagamoto, Tsu; Yukio Hashiya, Ise; Junji Kawaharada, Ichishi, all of Japan

[73] Assignee: Matsushita Electric Works, Ltd., Osaka, Japan

[21] Appl. No.: 357,818

[22] Filed: Mar. 15, 1982

[30] Foreign Application Priority Data

Jul. 22, 1981 [JP] Japan ..... 56-114761

[51] Int. Cl.[3] ..... H01H 51/22

[52] U.S. Cl. ..... 335/79; 335/230

[58] Field of Search ..... 335/79, 78, 230, 128

[56] References Cited

U.S. PATENT DOCUMENTS

| | | | |
|---|---|---|---|
| 2,941,130 | 6/1960 | Fischer et al. | 335/230 |
| 3,745,496 | 7/1973 | Tichy | 335/230 |
| 4,064,471 | 12/1977 | Schuessler et al. | 335/78 |

FOREIGN PATENT DOCUMENTS 4828122 8/1973 Japan .

*Primary Examiner*—Harold Broome

*Attorney, Agent, or Firm*—Stevens, Davis, Miller & Mosher

[57] ABSTRACT

An auto-holding electromagnetic relay is described comprising a main yoke having perpendicular and horizontal parts at right angles to each other. An exciter coil is mounted on the inner surface of the perpendicular part. On the outer surface of the horizontal part is mounted a permanent magnet on the upper surface of which is mounted an auxiliary yoke, one end of which is adapted to pivotably mount the armature. The main yoke has a main yoke projection extending from its perpendicular part which includes a horizontal projection part extending above and in the same direction as the horizontal part of the main yoke. The armature has an armature projection extending over the horizontal part of the main yoke projection and is capable, on pivoting of the armature, of making contact with it.

7 Claims, 18 Drawing Figures

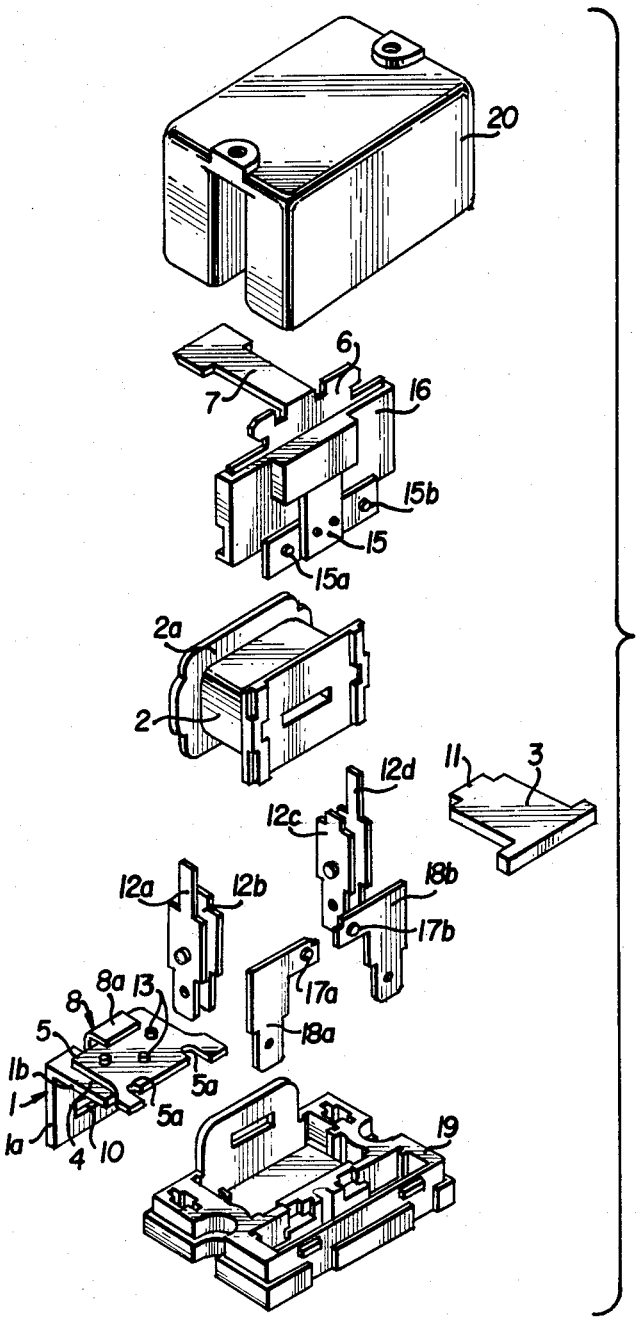
FIG. 1
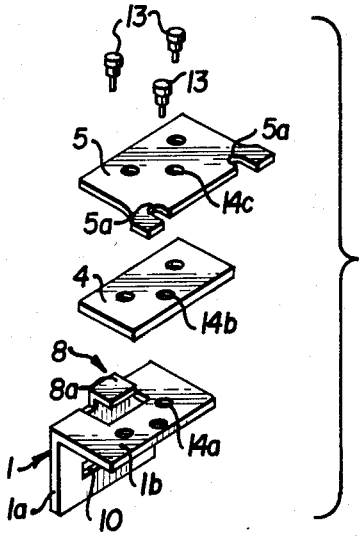
FIG. 2
FIG. 3
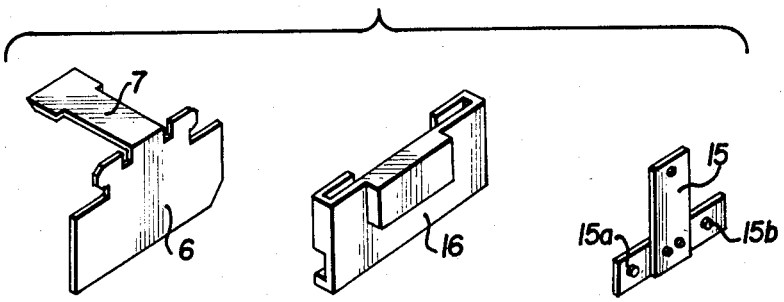

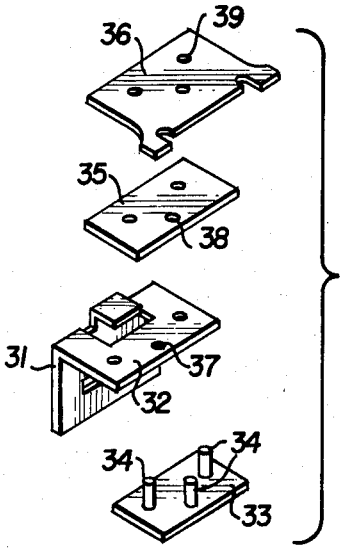
FIG. 10
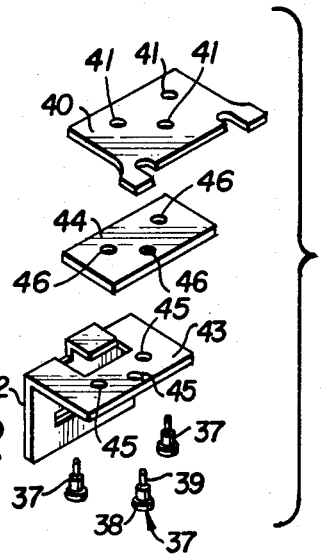
FIG. 12
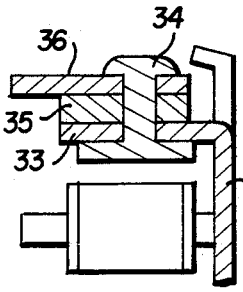
FIG. 11
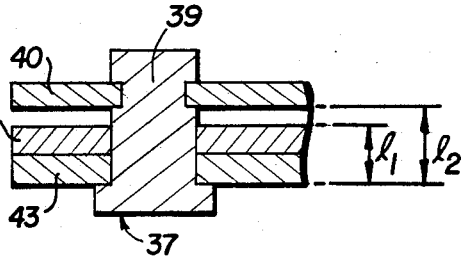
FIG. 13
FIG. 14a PRIOR ART
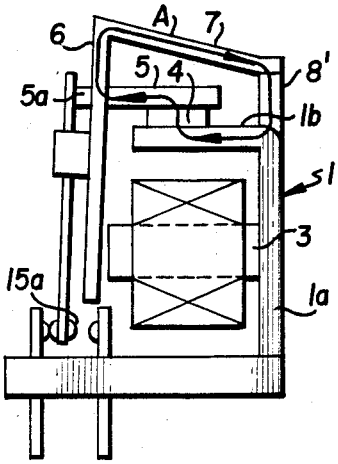
FIG. 14b PRIOR ART
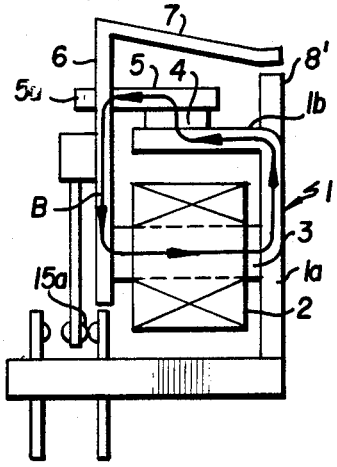
FIG. 15 PRIOR ART
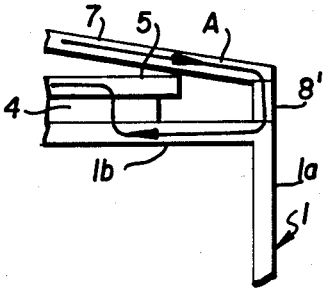
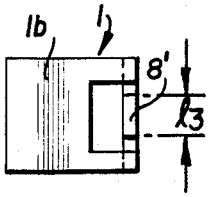
FIG. 16a PRIOR ART
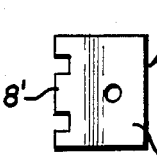
FIG. 16b PRIOR ART

ELECTROMAGNETIC RELAY

BACKGROUND OF THE INVENTION

This invention concerns an auto-holding type of electromagnetic relay, i.e., an electromagnetic relay having means to magnetically retain its contacts in their position (closed or open) determined during actuation of its electromagnetic exciter coil. Such relays are also referred to as magnetic latching relays. Auto-holding electromagnetic relays as such have been known and are, for example, described in Japan Utility Patent "Koho" No. 48-28122 (1973). However, with such conventional auto-holding relays, it is difficult to achieve sufficient magnetic force to assure retention of the contacts in their determined position because such relays are so designed that in at least one of their magnetic auto-holding circuits the magnetic resistance is too high.

SUMMARY OF THE INVENTION

The object of the claimed invention is to provide an auto-holding electromagnetic relay to designed as to achieve sufficient magnetic force in all of its magnetic auto-holding circuits to assure retention of its contacts in their determined position. This end is achieved by the unique design of the claimed invention which results in low magnetic resistance (and thus high magnetic force) in its magnetic auto-holding circuits.

Yet another object of this invention is to provide an electromagnetic relay which has good insulation properties between its main yoke and its exciter coil, and in which a permanent magnet is used to provide certainty in operation and to insure that the magnetic effectiveness of the relay does not decrease.

BRIEF DESCRIPTION OF THE DRAWINGS

FIG. 1 is an exploded perspective view of one embodiment of the electromagnetic relay of the claimed invention;

FIG. 2 is an exploded perspective view of the main yoke assembly of the electromagnetic relay of FIG. 1;

FIG. 3 is an exploded perspective view of the armature assembly of the electromagnetic relay of FIG. 1;

FIG. 10 is an exploded perspective view of a third embodiment of the main yoke assembly useful in the electromagnetic relay of the claimed invention;

FIG. 11 is a detail, in cross-section, of the third main yoke assembly embodiment of FIG. 10, as assembled;

FIG. 12 is an exploded perspective view of a fourth embodiment of the main yoke assembly useful in the electromagnetic relay of the claimed invention;

FIG. 13 is a detail, in cross-section, of the fourth main yoke assembly embodiment of FIG. 12, as assembled;

FIGS. 14(*a*) and 14(*b*) are schematic front views of a conventional auto-holding type electromagnetic relay illustrating the magnetic auto-holding circuits thereof;

FIG. 15 is a detail of the front view of the conventional auto-holding electromagnetic relay of FIGS. 14(*a*) and 14(*b*), detailing one of the magnetic auto-holding circuits thereof;

FIGS. 16(*a*) and 16(*b*) are top and side views, respectively, of the main yoke of the conventional auto-holding electromagnetic relay of FIGS. 14(*a*) and 14(*b*).

DETAILED DESCRIPTION OF THE INVENTION

Figure 4:
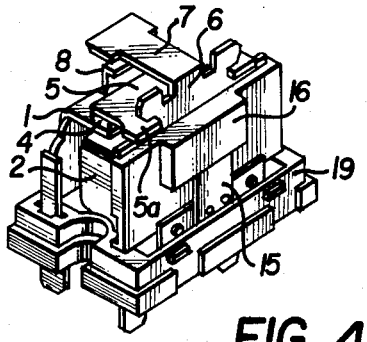
FIG. 4 is a perspective view of the electromagnetic relay of FIG. 1, as assembled, but without its casing.

Referring first to FIGS. 14(*a*), 14(*b*) and 15 and 16, these illustrate a conventional auto-holding electromagnetic relay such as that disclosed in Japan Utility Patent "Koho" No. 48-28122 (1973) having a reverse (and inverted) L-shaped main yoke 1 comprised of a perpendicular part 1*a* and a horizontal part 1*b* which extends from one end of perpendicular part 1*a* at substantially a right angle. The surfaces of the perpendicular part 1*a* and horizontal part 1*b* which face each other may be referred to as the inner surfaces of those respective parts. Conversely, the other surfaces of those two parts, which do not face one another, may be referred to as the outer surfaces of those respective parts. A cylindrical exciter coil 2, which includes an iron core 3 inserted therein, is mounted on the inner surface of perpendicular part 1*a* so that horizontal piece 1*b* extends oer it. A permanent magnet 4 is affixed to the outer surface (or top) of horizontal part 1*b*. The two surfaces of the permanent magnet 4 parallel to the outer surface of horizontal part 1*b* may, for convenience, be labelled as the upper and lower surfaces of permanent magnet 4, the lower surface of permanent magnet 4 being the one closest to the outer surface of horizontal part 1*b*. Affixed to the upper surface (or top) of permanent magnet 4 is auxiliary yoke 5. The end of auxiliary yoke furthest from perpendicular part 1*a* is formed as an armature supoort 5*a*. The two surfaces of auxiliary yoke 5 parallel to the upper surface of permanant magnet 4 may, for convenience, be labelled as the upper and lower surfaces of auxiliary yoke 5, the lower surface of auxiliary support 5 being the one closest to the upper surface of permanent magnet 4. Drive armature 6 is pivotably supported by armature support 5*a* and has affixed thereto movable contact 15*a*. Drive armature 6 has an upper and lower end, the upper end being the end closest to (and pivotably mounted on) armature support 5*a* of auxiliary yoke 5. Drive armature 6 also has inner and outer surfaces, the inner surface being that which faces the inner surface of perpendicular part 1*a* of main yoke 1. The free (i.e., unmounted) end of iron core 3 thus also faces the inner surface of drive armature 6. Movable contact 15*a* is mounted on the outer surface of armature 6. In addition, drive armature 6 includes an L-shaped armature projection 7, extending from the upper end of armature 6, which projects over the horizontal part 1*b* of main yoke 1. A main yoke projection 8′ extends upward from the same end of perpendicular part 1*a* as horizontal part 1*b* but continues in the direction of perpendicular part 1*a*. The relative placement of armature projection 7 and projecting main yoke projection 8′ is such that the former extends over and is opposed to the latter. Contact of the two forms one of the two magnetic auto-holding circuits of the relay. In FIGS. 14(a) and 14(*b*), the arrows A and B denote the magnetic circuits for the two holding positions, respectively. (Hereafter, these circuits A and B will be called latch position A and latch position B). In latch position A shown by the arrow A, the magnetic resistance changes abruptly at the junction comprised of the opposing surfaces of armature projection 7 and the main yoke projection 8'. When the opposing surface area of contact is small, the magnetic resistance of the contact junction is large and magnetic saturation occurs easily; this results in the inability of the relay to maintain holding action between these two contacting surfaces due to the resulting low magnetic attractive force. In the example of a conventional auto-holding relay shown, the effective contact surface area is determined by the surface area of the contacting surface of the main yoke projection 8'. The width dimension of main yoke projection 8' designated ($1_3$) cannot be made too large in this conventional relay (because the magnetic resistance of main yoke 1 would increase) and thus the contact surface of the junction of armature projection 7 and yoke projection 8' cannot have a sufficiently small magnetic resistance. This results in low magnetic attractive force at this contact surface in latch position A which makes assured holding action of the relay difficult, if not impossible, to achieve.

Referring now to FIGS. 1 through 8, which describe an embodiment of the claimed invention, main yoke 1 having the shape of an inverted L includes perpendicular part 1*a* in the center of which is a hole 10. A cylindrical-shaped exciter coil 2 is mounted over hole 10. Within the exciter coil 2 is an iron core 3. Tab 11 at one end of iron core 3 is friction-fitted into hole 10. Main yoke 1 also includes a horizontal part 1*b* which extends from one end of perpendicular part 1*a* at substantially a right angle. The surfaces of the perpendicular part 1*a* and horizontal part 1*b* which face each other may be referred to as the inner surfaces of those respective parts. Conversely, the other surfaces of those two parts, which do not face one another, may be referred to as the outer surfaces of those respective parts. Horizontal part 1*b* extends over exciter coil 2. Exciter coil 2 is wound around a coil frame 2*a* in a two-layered winding, and the reverser drive for the relay has each winding wire connected at each end to the coil terminals 12*a*–12*d*. Permanent magnet 4 is affixed to the outer surface (or top ) of horizontal part 1*b*. The two surfaces of permanent magnet 4 parallel to the outer surface of horizontal part 1*b* may, for convenience, be labelled as the upper and lower surfaces of permanent magnet 4, the lower surface of permanent magnet 4 being the one closest to the outer surface of horizontal part 1*b*. Affixed to the upper surface (or top) of permanent magnet 4 is auxiliary yoke 5 which has an armature support 5*a* formed at one of its end furthest from perpendicular part 1*a*. The two surfaces of auxiliary yoke 5 parallel to the upper surface permanent of magnet 4 may, for convenience, be labelled as the upper and lower surfaces of auxiliary yoke 5, the lower surface of auxiliary yoke 5 being the one closest to the upper surface of permanent magnet 4. The lines of force of magnet 4 are generally in the same direction as the long dimension of perpendicular part 1*a* of main yoke 1, i.e., perpendicular to horizontal part 1*b*. Via corresponding holes 14*a*, 14*b* and 14*c* in horizontal piece 1*b* of main yoke 1, permanent magnet 4 and auxiliary yoke 5, respectively, main yoke 1, permanent magnet 4 and auxiliary yoke 5 are affixed together by non-magnetic rivets 13. A main yoke projection 8 having an inverted L-shape extends from the same end of perpendicular part 1*a* of main yoke 1 as horizontal part 1*b*. In the example shown, main yoke projection part 8 is cut from horizontal part 1*b*. Main yoke projection 8 includes a perpendicular main yoke projection part which extends from the same end of perpendicular part 1*a* of main yoke 1 as horizontal part 1*b* but continues in the same direction as perpendicular part 1*a*. Horizontal main yoke projection part 8*a* extends from the end of perpendicular main yoke projection part furthest from perpendicular part 1*a* but in the same direction as horizontal part 1*b;* i.e., substantially at a right angle to the perpendicular main yoke projection part. Thus the perpendicular and horizontal main yoke projection parts may be said to have respective inner and outer surfaces in the same way that the perpendicular and horizontal parts 1*a*, 1*b* of main yoke 1 do. Armature 6 is pivotably supported by armature support 5*a* of auxiliary yoke 5 and has affixed thereto movable contact 15*a*. Armature 6 has an upper and a lower end, the upper end being the end closest to (and pivotably mounted on) armature support 5*a* of auxiliary yoke 5. Armature 6 also has an inner and outer surface, the inner surface being that which faces the inner surface of perpendicular part 1*a* of main yoke 1. The free (i.e. unmounted) end of iron core 3 thus faces the inner surface of armature 6 as well. Movable contact 15*a* is mounted on the outer surface of armature 6. A reverse (and inverted) L-shaped armature projection 7 extends from the upper end and perpendicularly from armature 6 and has a tip which extends over main yoke 1, including main yoke projection 8, and opposes the outer surface of the horizontal portion 8*a* of main yoke projection 8. On the outer surface of armature 6 is a T-shaped movable contact spring 15 which is affixed with synthetic resin to a holding part 16 which is itself affixed to armature 6. Both ends of the horizontal part of movable contact spring 15 have movable contacts 15*a* and 15*b*, respectively, which oppose fixed points 17*a* and 17*b* respectively, on their respective fixed terminals 18*a* and 18*b*. Base 19, which may be formed of synthetic resin, constitutes a platform on which main yoke 1, coil terminals 12*a* through 12*d* and the fixed terminal 18*a* and 18*b* are mounted. Casing 20, which also may be made of synthetic resin, encloses a fully assembled operating parts on their base 19.

Figure 5:
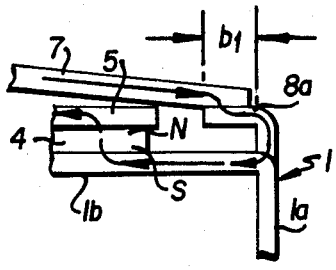
FIG. 5 is a detail of a front view of the electromagnetic relay of FIG. 1, illustrating one of the magnetic auto-holding circuits thereof.

In the embodiment illustrated in FIGS. 1 through 8, the extent of the opposing outer surace of horizontal main yoke projection part 8*a* and armature projection 7 which actually come into contact are, as is shown in FIG. 5, determined by the length ($b_1$) of the horizontal portion 8*a*. Appropriate establishment of the surface area of the outer surface of the horizontal portion 8*a* of main yoke projection 8 can make the contact area between the armature projection 7 and main yoke projection 8 have a low magnetic resistance, which has the effect of increasing the magnetic attraction force in latch position A shown in FIG. 5 to provide sure and secure latching.

Figure 6:
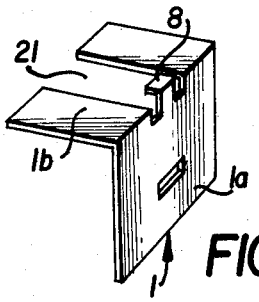
FIG. 6 is a perspective view of the main yoke of a second embodiment of the electromagnetic relay of the claimed invention.
Figure 7:
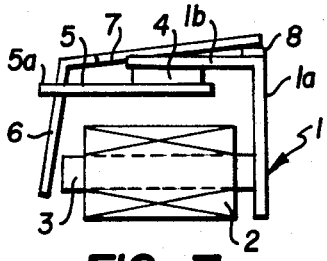
FIG. 7 is a schematic front view of the second embodiment of the electromagnetic relay of the claimed invention.

FIGS. 6 and 7 show another embodiment, in which permanent magnet 4 is affixed to the inner surace of horizontal piece 1*b* of main yoke 1, and auxiliary yoke 5 is affixed to the lower surface of permanent magnet 4. In this embodiment, there is a cut-away 21 in the center of the horizontal piece 1*b* of main yoke 1, and in latch position A, armature projection 7 can be positioned within this cut-away 21, and this, compared with the former technology, allows a lower dimensional height for the relay.

Figure 8:
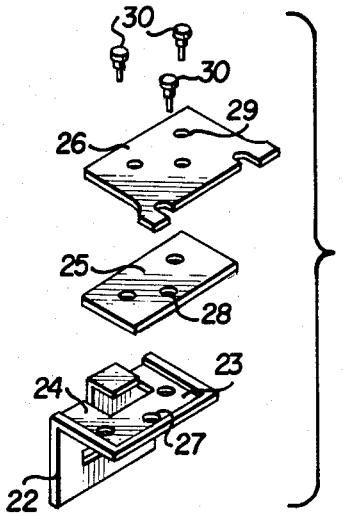
FIG. 8 is an exploded perspective view of a second embodiment of the main yoke assembly useful in the electromagnetic relay of the claimed invention.
Figure 9:
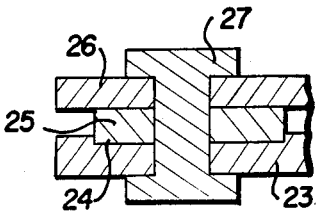
FIG. 9 is a detail, in cross-section, of the second main yoke assembly embodiment of FIG. 8, as assembled.

FIG. 8 shows a variation of the main yoke assembly in which the outer surface of the horizontal piece 23 of the main yoke 22 has a concave portion or recess 24 and in this concave area, permanent magnet 25 is placed and affixed. The permanent magnet 25 has affixed to its upper surface auxiliary yoke 26. Affixation is accomplished by rivets 30 made from a non-magnetic metal which pass through corresponding holes 27, 28, and 29 in horizontal piece 23 of main yoke 22, permanent magnet 25 and auxiliary yoke 26, respectively, so that, as FIG. 9 shows, permanent magnet 25, auxiliary yoke 26 and main yoke 22 are affixed together.

FIG. 10 shows yet another variation of the main yoke assembly in which there is a plate 33 of fuseable material, such as synthetic resin, on the inner surface of the horizontal part 32 of the main yoke 31, the upper surface of the plate (i.e., that closest to the inner surface of horizontal part 32) having a plurality of posts 34 of fuseable material. These posts 34 pass through corresponding holes 37, 38, 39 in horizontal piece 32 of main yoke 31, permanent magnet 35, and auxiliary yoke 36, respectively. As FIG. 11 shows, through fusion of the upper parts of the posts 34, main yoke 31, permanent magnet 35 and auxiliary yoke 36 may be affixed together.

Further, as is shown in FIG. 12, another possibility of affixing the components of the main yoke assembly is to have a large diameter head 38 and a small diameter stem 39 on opposing ends of the central portion of the body of each of the non-magnetic rivets 37. In auxiliary yoke 40 there are small diameter holes 41 of about the same diameter as stems 39 through which they may be passed. In addition, there are corresponding large diameter holes 45 and 46 in horizontal part 43 of main yoke 42 and in permanent magnet 44, respectively, through which may pass the center portion of rivets 37 (i.e., the portion between the large diameter head 38 and small diameter stem 39) which is of about the same diameter as those holes. The sum of the thicknesses of the permanent magnet 44 and the thickness of the horizontal piece 43 is the dimension $l_1$, which is slightly smaller than the dimension $l_2$, which is the length of the center portion of rivet 37. Therefore, as shown in FIG. 13, in addition to passing through corresponding rivet holes 45 and 46, the small diameter stem 39 passes through the corresponding rivet hole 41 of auxiliary yoke 40. The diameter of the center portion of the rivets is such that it cannot pass through rivet hole 41 and the difference in the dimension $l_1$ and $l_2$ results in auxiliary yoke 40 being spaced from permanent magnet 4 on affixation of the main yoke assembly components.

What is claimed is:

1. An auto-holding type electromagnetic relay comprising:

a main yoke, said main yoke including a perpendicular part and a horizontal part integral with said perpendicular part, said horizontal part extending from one end of said perpendicular part at substantially a right angle to form inner and outer surfaces for each of said respective parts;

a hinge type electromagnet comprising an exciter coil mounted on the inner surface of said perpendicular part, so that said horizontal part extends over said exciter coil;

an iron core inserted in said exciter coil, said iron core being mounted by one of its ends on the inner surface of said perpendicular part;

a permanent magnet having upper and lower surfaces and mounted on the outer surface of said horizontal part by its lower surface such that it is in parallel arrangement with the electromagnet and its magnetic orientation is perpendicular to said horizontal part;

an auxiliary yoke having upper and lower surfaces and mounted by its lower surface on the upper surface of said permanent magnet, the end of said auxiliary yoke furthest from said perpendicular part of said main yoke being adapted to form an armature support;

an "L" shaped armature having an upper end and a lower end and inner and outer surfaces, said armature being pivotably mounted on said armature support by its upper end, the inner surface of the lower end of said armature facing the unmounted end of said iron core;

a contact on the outer surface of said armature;

a main yoke projection extending from the same end of said perpendicular part as said horizontal part and integral therewith, said main yoke projection having a perpendicular projection part extending from and in the same direction as the perpendicular part of said main yoke, and a horizontal projection part extending from the end of said perpendicular projection part furthest from the perpendicular part of said main yoke, said horizontal projection part extending substantially in the same direction as the horizontal part of said main yoke, thus forming substantially a right angle between said horizontal projection part and said perpendicular projection part to form inner and outer surfaces for each of said respective projection parts, said horizontal projection part and said perpendicular projection part being struck from the horizontal part of the main yoke and thus being integral with said main yoke;

an armature projection extending from the upper end of said armature at substantially a right angle and integral therewith;

said armature being so mounted on said auxiliary yoke that said armature projection extends over the outer surface of the horizontal projection part of said main yoke projection and is capable of making contact therewith by pivoting of said armature on said armature support.

2. An auto-holding type electromagnetic relay comprising:

a main yoke, said main yoke including a perpendicular part and a horizontal part integral with said perpendicular part, said horizontal part extending from one end of said perpendicular part at substantially a right angle to form inner and outer surfaces for each of said respective parts;

a hinge type electromagnet comprising an exciter coil mounted on the inner surface of said perpendicular part, so that said horizontal part extends over said exciter coil;

an iron core inserted in said exciter coil, said iron core being mounted by one of its ends on the inner surface of said perpendicular part;

a permanent magnet having upper and lower surfaces mounted by its upper surface on the inner surface of said horizontal part, such that it is in parallel arrangement with the electromagnet;

an auxiliary yoke having upper and lower surfaces and mounted by its upper surface on the lower surface of said permanent magnet, the end of said auxiliary yoke furthest from said perpendicular part of said main yoke being adapted to form an armature support;

an "L" shaped armature having an upper end and a lower end and inner and outer surfaces, said armature being pivotably mounted on said armature support by its upper end, the inner surface of the lower end of said armature facing the unmounted end of said iron core;

a contact on the outer surface of said armature;

a main yoke projection extending from the same end of said perpendicular part as said horizontal part and integral therewith, said main yoke projection having a perpendicular projection part extending from and in the same direction as the perpendicular part of said main yoke and a horizontal projection part extending from the end of said perpendicular projection part furthest from the perpendicular part of said main yoke, said horizontal projection part extending substantially in the same direction as the horizontal part of said main yoke, thus forming substantially a right angle between said horizontal projection part and said perpendicular projection part to form inner and outer surfaces for each of said respective projection parts, said horizontal projection part and said perpendicular projection part being struck from the horizontal part of the main yoke and thus being integral with said main yoke;

an armature projection extending from the upper end of said armature at substantially a right angle and integral therewith;

a main yoke cut-out extending the entire length of the horizontal part of said main yoke and having a width at least as great as said armature projection;

said armature being so mounted on said auxiliary yoke that said armature projection part extends over the outer surface of the horizontal projection part of said main yoke projection and is capable of making contact therewith by pivoting of said armature on said armature support.

3. The relay of claim 1 or 2, wherein said horizontal part of the said main yoke has a recess into which said permanent magnet is fitted.

4. The relay of claim 1 or 2, wherein said horizontal part of said main yoke, said permanent magnet and said auxiliary yoke are affixed together by non-magnetic rivets.

5. The relay of claim 1 or 2, wherein there are corresponding holes in said horizontal part of said main yoke, said permanent magnet and said auxiliary yoke and wherein a plate of fuseable material is mounted on the unmounted surface of said auxiliary yoke, said plate having fuseable pegs extending from its mounted surface through said corresponding holes, the ends of said pegs which have pressed through said holes being fused to a diameter greater than said holes, thus affixing said horizontal part of said main yoke, said permanent magnet and said auxiliary yoke together.

6. The relay of claim 5 in which the fuseable material is a synthetic resin.

7. The relay of claim 1 or 2, wherein the horizontal part of said main yoke, said permanent magnet and said auxiliary yoke are affixed together such that said permanent magnet and said auxiliary yoke are spaced from one another.

* * * * *